US009927137B2

(12) United States Patent
Hiraoka et al.

(10) Patent No.: US 9,927,137 B2
(45) Date of Patent: Mar. 27, 2018

(54) AIR-CONDITIONING CONTROL DEVICE GENERATING AIR-CONDITIONING CONTROL-DATA, AIR-CONDITIONING CONTROL METHOD, AND COMPUTER PROGRAM PRODUCT

(75) Inventors: Yukio Hiraoka, Tokyo (JP); Takanobu Tsuzaki, Tokyo (JP); Syuuji Kondoh, Saitama (JP); Shinya Kondo, Tokyo (JP); Akihiro Fujii, Saitama (JP); Hirotaka Okamoto, Tokyo (JP); Tomohiro Asazuma, Saitama (JP); Hiraku Asakura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 856 days.

(21) Appl. No.: 14/358,873

(22) PCT Filed: Jun. 15, 2012

(86) PCT No.: PCT/JP2012/065399

§ 371 (c)(1),
(2), (4) Date: Oct. 7, 2014

(87) PCT Pub. No.: WO2013/073223

PCT Pub. Date: May 23, 2015

(65) Prior Publication Data

US 2015/0051740 A1 Feb. 19, 2015

(30) Foreign Application Priority Data

Nov. 18, 2011 (JP) ..... 2011-252518

(51) Int. Cl.
*F24F 11/00* (2018.01)

(52) U.S. Cl.
CPC ..... *F24F 11/0009* (2013.01); *F24F 11/30* (2018.01); *F24F 11/62* (2018.01); *F24F 11/64* (2018.01)

(58) Field of Classification Search
None
See application file for complete search history.

(56) References Cited

U.S. PATENT DOCUMENTS 5,170,935 A * 12/1992 Federspiel ..... F24F 11/0009 236/44 C
5,762,265 A 6/1998 Kitamura et al.
(Continued)

FOREIGN PATENT DOCUMENTS

CN 1884934 A 12/2006
CN 102162664 A 8/2011
(Continued)

OTHER PUBLICATIONS

Office Action dated Sep. 24, 2015 in Japanese Patent Application No. 2011-252518 (with English language translation).
(Continued)

*Primary Examiner* — Wissam Rashid
(74) *Attorney, Agent, or Firm* — Oblon, McClelland, Maier & Neustadt, L.L.P.

(57) ABSTRACT

An air-conditioning control device includes a conversion definition information storage unit, an air-conditioning control computation unit, and a gateway unit. The conversion definition information storage unit preliminarily stores conversion definition information for converting air-conditioning control original data acquired from an external air-conditioning facility into computational data for performing an air-conditioning control computation or conversion definition information for converting air-conditioning control computation resultant data acquired as a result of the air-conditioning control computation into air-conditioning control data used for air-conditioning control at the air-conditioning facility. The air-conditioning control computation unit performs the air-conditioning control computation based on the computational data, and outputs the air-condi-
(Continued)

tioning control computation resultant data. The gateway unit refers to the conversion definition information to convert the air-conditioning control original data into the computational data or to convert the air-conditioning control computation resultant data into the air-conditioning control data.

10 Claims, 10 Drawing Sheets

(56) References Cited

U.S. PATENT DOCUMENTS

| | | | | |
|---|---|---|---|---|
| 2002/0029096 | A1 | 3/2002 | Takai et al. | |
| 2005/0209739 | A1 | 9/2005 | Kwon et al. | |
| 2006/0212175 | A1 | 9/2006 | Kim et al. | |
| 2006/0234621 | A1* | 10/2006 | Desrochers | F24F 3/044 454/239 |
| 2008/0116287 | A1 | 5/2008 | Murakami et al. | |
| 2008/0185447 | A1* | 8/2008 | Kim | F24F 11/006 236/51 |
| 2008/0185449 | A1 | 8/2008 | Cha et al. | |
| 2011/0205366 | A1 | 8/2011 | Enohara et al. | |

FOREIGN PATENT DOCUMENTS

| | | | |
|---|---|---|---|
| EP | 1 703 684 | A1 | 9/2006 |
| EP | 1 953 469 | A2 | 8/2008 |
| JP | 2001-108284 | | 4/2001 |
| JP | 2002-31391 | A | 1/2002 |
| JP | 2002-150051 | A | 5/2002 |
| JP | 2002-156143 | | 5/2002 |
| JP | 2005-003281 | | 1/2005 |
| JP | 2005-73055 | A | 3/2005 |
| JP | 2005-157829 | A | 6/2005 |
| JP | 2007-003096 | | 1/2007 |
| JP | 2007-327655 | A | 12/2007 |
| JP | 2007-327656 | A | 12/2007 |
| JP | 2009-052769 | | 3/2009 |
| JP | 2011-174665 | | 9/2011 |
| JP | 2011-179722 | A | 9/2011 |
| WO | WO 2006/082942 | A1 | 8/2006 |

OTHER PUBLICATIONS

Extended European Search Report dated Jul. 3, 2015 in Patent Application No. 12737692.9.

International Search Report dated Sep. 18, 2012 in PCT/JP12/065399 filed Jun. 15, 2012.

Office Action dated May 10, 2016 in Japanese Patent Application No. 2011-252518 (with English language translation).

Combined Chinese Office Action and Search Report dated Mar. 23, 2015 in Patent Application No. 201280000738.7 (with English translation of categories of cited documents).

Office Action dated Apr. 25, 2017 in Japanese Patent Application No. 2011-25218.

* cited by examiner

FIG.4

61

| 71 BUILDING ID | 72 LATITUDE | 73 LONGITUDE | 74 (INFORMATION ON PLACEMENT OF BUILDING) | 75 (INFORMATION ON OBSTACLES) | 76 SEQUENCE NUMBER |
|---|---|---|---|---|---|
| 1 | 36.3 | 140.1 | | | 1 |
| | | | | | |
| | | | | | |
| | | | | | |
| | | | | | |
| | | | | | |
| | | | | | |

FIG.5

62

| 81 BUILD-ING ID | 82 AREA ID | 83 AREA SIZE | 91 ADJACENT AREA NUMBER | 92 WALL SURFACE INFORMATION | 93 WINDOW INFOR-MATION | ··· | 85 AMOUNT OF CLOTH-ING | 86 AMOUNT OF ACTIVITY | 87 PMV TARGET VALUE | 88 SEQUENCE NUMBER |
|---|---|---|---|---|---|---|---|---|---|---|
| 1 | 1 | 120 | 2 | | | | 0.5 | 1.2 | 0.00 | 1 |
| 1 | 2 | 180 | 1 | | | | 0.5 | 1.2 | 0.00 | 1 |
| 1 | 3 | 120 | 4 | | | | 0.5 | 1.2 | 0.00 | 1 |
| 1 | 4 | 180 | 3 | | | | 0.5 | 1.2 | 0.00 | 1 |
| 1 | 5 | 300 | 6 | | | | 0.5 | 1.5 | 0.00 | 2 |
| 1 | 6 | 300 | 5 | | | | 0.5 | 1.5 | 0.00 | 1 |
| | | | | | | | | | | |

84

FIG.6

63

| 101 BUILDING ID | 102 AREA ID | 103 PMV TARGET VALUE | 104 ROOM TEMPERATURE | 105 ROOM HUMIDITY | 106 TEMPERATURE SETTING | 107 AIR-CONDITIONER OPERATION STATUS | 108 111 TEMPERATURE SETTING | 108 112 CURRENT PMV VALUE | 109 BUILDING INFORMATION SEQUENCE NUMBER | 110 AREA INFORMATION SEQUENCE NUMBER |
|---|---|---|---|---|---|---|---|---|---|---|
| 1 | 1 | 0.00 | 26.0 | 55 | 26.0 | ON | | | 1 | 1 |
| 1 | 2 | 0.00 | 26.2 | 52 | 26.5 | ON | | | 1 | 1 |
| | | | | | | | | | | |
| | | | | | | | | | | |
| | | | | | | | | | | |
| | | | | | | | | | | |
| | | | | | | | | | | |

AIR-CONDITIONING CONTROL DEVICE GENERATING AIR-CONDITIONING CONTROL-DATA, AIR-CONDITIONING CONTROL METHOD, AND COMPUTER PROGRAM PRODUCT

CROSS-REFERENCE TO RELATED APPLICATIONS

This application is national stage application of International Application No. PCT/JP2012/065399, filed Jun. 15, 2012, which designates the United States, incorporated herein by reference, and which claims the benefit of priority from Japanese Patent Application No. 2011-252518, filed Nov. 18, 2011, the entire contents of which are incorporated herein by reference.

TECHNICAL FIELD

Embodiments described herein relate generally to an air-conditioning control device, an air-conditioning control method, and a computer program product.

BACKGROUND ART

In building facilities such as buildings, offices, factories, and shopping malls, adoption of a building management system has been progressing so far to efficiently manage and monitor a facility such as a power receiving, power transforming, and private power generating facility, a heat source and air-conditioning facility, and a lighting, crime prevention, and disaster prevention facility.

In the above-described building facilities, in particular, the heat source and air-conditioning facility is the facility that directly acts on a space where people are present, and accounts for a large proportion of energy consumption in the building facilities.

Accordingly, an air-conditioning control system that makes people feel comfortable and leads to energy conservation is desired. As for such a system, a variety of techniques has been proposed such as a method that performs the control focused on an index of a so-called predicted mean vote (PMV) indicative of comfort of space.

Typically, a building management system is implemented with an air-conditioning control method of each company who developed the building management system. Therefore, even if there is a more suitable air-conditioning control method, it is extremely difficult to apply such air-conditioning control method to an existing building management system made by another company.

BRIEF DESCRIPTION OF DRAWINGS

FIG. 4 is an explanatory diagram of an example of a data format of a building information database according to the embodiment;

FIG. 5 is an explanatory diagram of an example of a data format of an area information database according to the embodiment;

FIG. 6 is an explanatory diagram of an example of a data format of a computation request database according to the embodiment;

According to an embodiment, an air-conditioning control device includes a conversion definition information storage unit, an air-conditioning control computation unit, and a gateway unit. The conversion definition information storage unit preliminarily stores therein conversion definition information for converting air-conditioning control original data acquired from an external air-conditioning facility into computational data for performing an air-conditioning control computation or conversion definition information for converting air-conditioning control computation resultant data acquired as a result of the air-conditioning control computation into air-conditioning control data used for air-conditioning control at the air-conditioning facility. The air-conditioning control computation unit performs the air-conditioning control computation based on the computational data, and outputs the air-conditioning control computation resultant data. The gateway unit refers to the conversion definition information to convert the air-conditioning control original data into the computational data for the air-conditioning control computation or to convert the air-conditioning control computation resultant data acquired as a result of the air-conditioning control computation into the air-conditioning control data to be used for the air-conditioning control at the air-conditioning facility.

MODE(S) FOR CARRYING OUT THE INVENTION

An embodiment will be explained with reference to the accompanying drawings.

Figure 1:
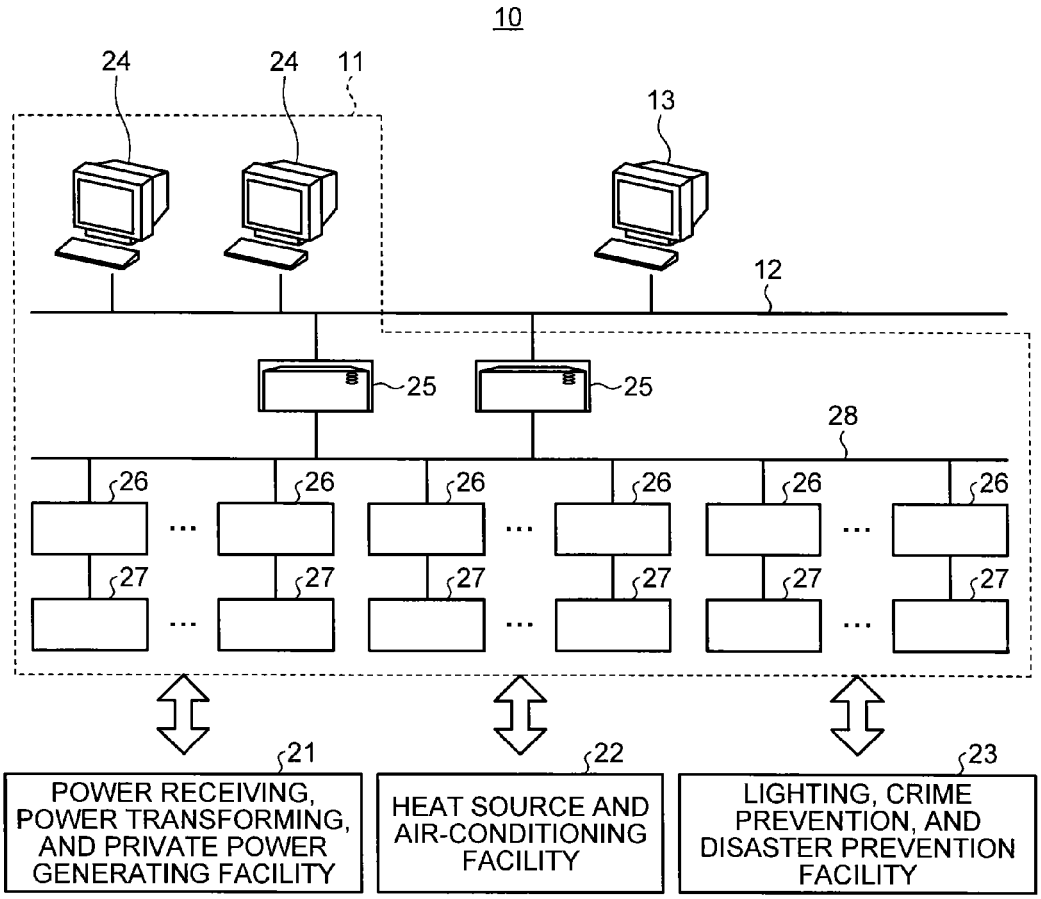
FIG. 1 is a block diagram of a schematic configuration of a building management system according to an embodiment.

FIG. 1 is a block diagram of a schematic configuration of a building management system according to an embodiment.

A building management system 10 includes a building management body system 11, a first data transmission path 12, and an air-conditioning control device 13.

The building management system 10 here manages each facility in a building such as: a power receiving, power transforming, and private power generating facility 21; a heat source and air-conditioning facility 22; and a lighting, crime prevention, and disaster prevention facility 23.

The building management body system 11 includes human interface devices 24, servers 25, a plurality of controllers 26, and a plurality of remote stations 27.

The human interface device 24 is used to intensively monitor each facility in the building such as: the power receiving, power transforming, and private power generating facility 21; the heat source and air-conditioning facility 22; and the lighting, crime prevention, and disaster prevention facility 23.

The server 25 saves and accumulates therein definition information required for managing the above-described facilities 21 to 23 and data collected from the facilities 21 to 23.

The controller 26 is associated with one of the facilities 21 to 23, and the controllers 26 are provided for each of the facilities to control the associated one of the facilities.

The remote station 27 performs interface operation with devices, sensors, and others constituting the facilities 21 to 23.

In the above-described configuration, each of the controllers 26 and the servers 25 associated with the respective controllers 26 are connected to communicate via a second data transmission path 28.

Figure 2:
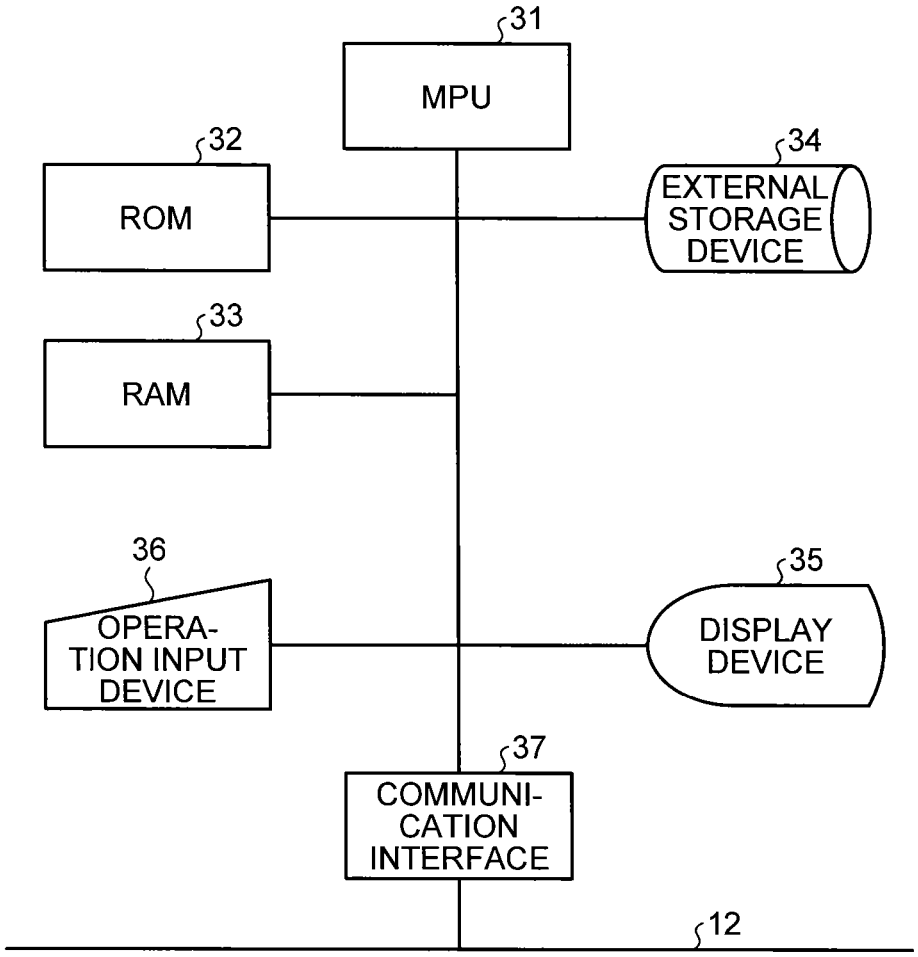
FIG. 2 is a block diagram of a schematic configuration of an air-conditioning control device according to the embodiment.

FIG. 2 is a block diagram of a schematic configuration of the air-conditioning control device.

The air-conditioning control device 13 includes, as illustrated in FIG. 2, an MPU 31, a ROM 32, a RAM 33, an external storage device 34, a display device 35, an operation input device 36, and a communication interface device 37.

The MPU 31 of the air-conditioning control device 13 controls the entire air-conditioning control device 13.

The ROM 32 stores therein, in a non-volatile manner, various types of data including a control program for the MPU 31 to operate.

The RAM 33 temporarily stores therein various types of data and serves as a work area.

The external storage device 34 is configured as a hard disk drive and such, and stores therein large data such as later described databases.

The operation input device 36 is configured with a touch panel, a keyboard, a mouse, and the like, not illustrated, through which an operator inputs various types of data.

The communication interface device 37 performs communication via the first data transmission path 12.

Figure 3:
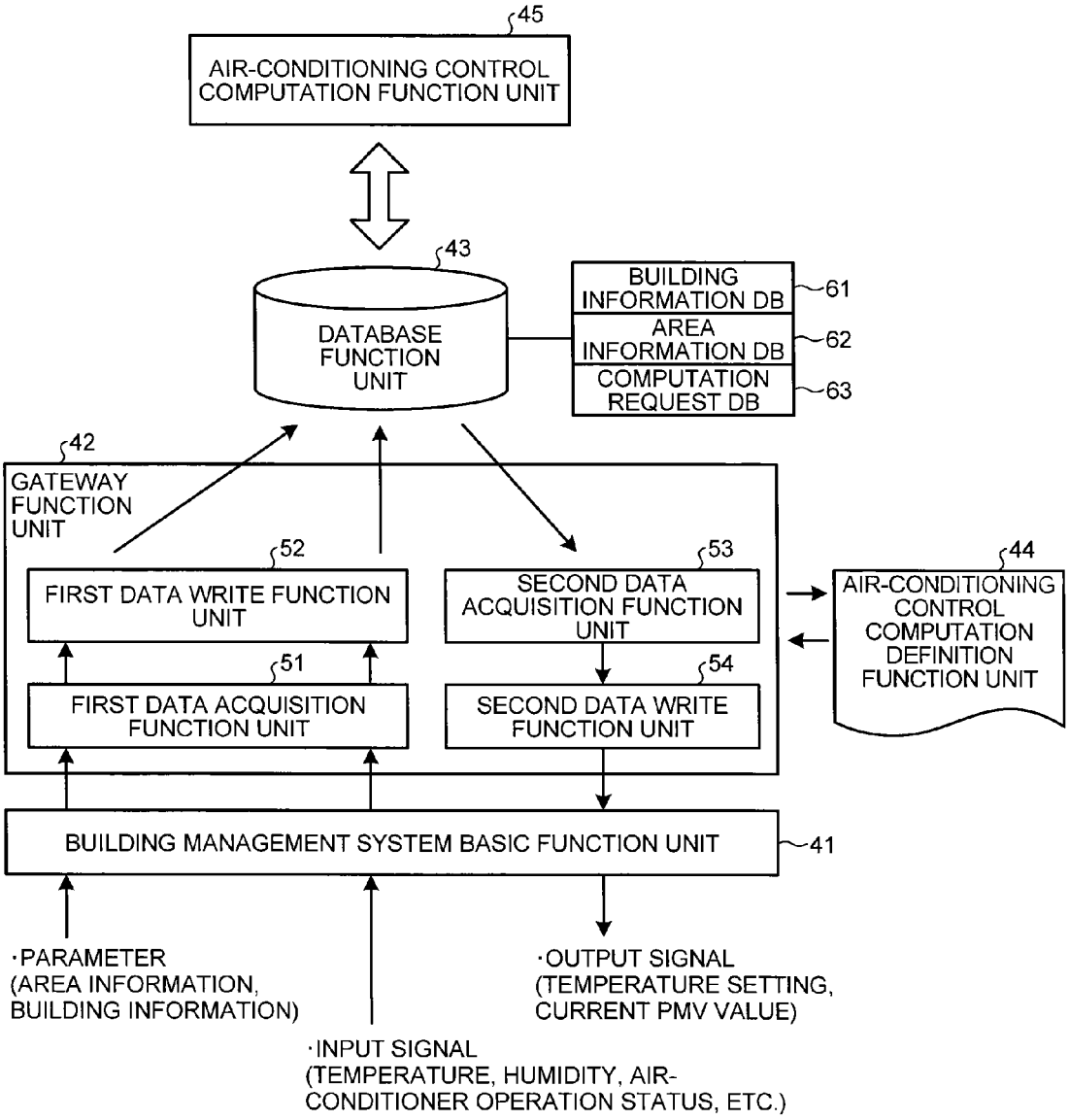
FIG. 3 is a block diagram of a functional configuration of the air-conditioning control device according to the embodiment.

FIG. 3 is a block diagram illustrating a functional configuration of the air-conditioning control device.

In this case, the building management body system 11 is connected to the air-conditioning control device 13 in a state in which the building management body system 11 is serving as a building management system basic function unit 41 as a whole.

The building management body system 11 as the building management system basic function unit 41 controls the heat source and air-conditioning facility 22 under the control of the air-conditioning control device 13.

More specifically, the building management system basic function unit 41 identifies a target to be managed from parameters such as area information for identifying an area of a target to be managed and building information for identifying a building to which the area of the target to be managed belongs. The building management system basic function unit 41 then outputs, based on an input signal indicative of a temperature, a humidity, an air-conditioning operation status, and such received from the target to be managed, a temperature setting for a target value (a target PMV value) of a so-called predicted mean vote (PMV) value to the relevant target to be managed, as an output signal to perform the control. Here, the PMV value is a value indicative of comfort of space.

For the above-described building management system basic function unit 41, the air-conditioning control device 13 provides a gateway function unit 42, a database function unit 43, an air-conditioning control computation definition function unit 44, and an air-conditioning control computation function unit 45.

The gateway function unit 42 includes a first data acquisition function unit 51, a first data write function unit 52, a second data acquisition function unit 53, and a second data write function unit 54.

The first data acquisition function unit 51 acquires various types of data required for control from the building management system basic function unit 41.

The first data write function unit 52 refers to the air-conditioning control computation definition function unit 44 and converts various types of data acquired from the first data acquisition function unit 51 into a common data format in which the air-conditioning control computation function unit 45 can compute. The first data write function unit 52 further writes the various types of data converted into the common data format to the database function unit 43 as computation request data.

The second data acquisition function unit 53 acquires air-conditioning control computation resultant data computed by the air-conditioning control computation function unit 45 from the database function unit 43.

The second data write function unit 54 refers to the air-conditioning control computation definition function unit 44, and converts the air-conditioning control computation resultant data acquired by the second data acquisition function unit 53 into individual control output data usable in a device constituting the actual building management system basic function unit 41, so as to output the data to the building management system basic function unit 41.

As in the foregoing, in the database function unit 43, the data from the building management system basic function unit 41 is written in the common data format regardless of specifications of devices or systems actually constituting the building management system basic function unit 41.

Meanwhile, the data to the building management system basic function unit 41 is again made as individual control output data that complies with the specifications of devices or systems actually constituting the building management system basic function unit 41.

Accordingly, the air-conditioning control device 13 can be made in a common specification with respect to the building management system basic function unit 41 of various specifications.

The database function unit 43 is roughly divided to include a building information database (DB) 61, an area information database (DB) 62, and a computation request database (DB) 63.

Now, the database function unit 43 will be explained with reference to the accompanying drawings.

FIG. 4 is an explanatory diagram of an example of a data format of the building information database.

The building information database 61 includes building ID data 71, latitude data 72, longitude data 73, building placement information data 74, obstacle information data 75, and sequence number data 76.

The building ID data 71 of the building information database 61 stores therein a building ID for identifying a building.

The latitude data 72 stores therein latitude information at a location of the building.

The longitude data 73 stores therein longitude information at the location of the building.

The building placement data 74 stores therein the information on placement of the building.

The obstacle information data 75 stores therein the information concerning obstacles in the surrounding area of the building.

The sequence number data 76 stores therein a building sequence number that is used to determine whether the building information is updated.

FIG. 5 is an explanatory diagram of an example of a data format of the area information database.

The area information database 62 is roughly divided to include building ID data 81, area ID data 82, area size data 83, a group of data 84 for an adjacent area, data 85 for an amount of worn clothing, data 86 for an amount of activity, PMV target value data 87, and sequence number data 88.

The building ID data 81 of the area information database 62 stores therein a building ID for identifying a building where an air-conditioning target area is provided.

The area ID data 82 stores therein an area ID for identifying the air-conditioning target area.

The area size data 83 stores therein size information of the area identified by the area ID data 82.

The group of data 84 of an adjacent area stores therein the information concerning an area adjacent to the area identified by the area ID data 82.

The data 85 for the amount of worn clothing relates to calculation of a temperature setting, and is an index indicative of an amount of clothing worn by people in the air-conditioning target area.

The data 86 for the amount of activity relates to the calculation of a temperature setting, and is an index indicative of an amount of activity of the people in the air-conditioning target area.

The PMV target value data 87 stores therein a target PMV value.

The sequence number data 88 stores therein an air-conditioning area sequence number used to determine whether the area information of the air-conditioning target area is updated.

In the above-described configuration, the group of data 84 for an adjacent area includes information on an adjacent area, and includes: adjacent area number data 91 storing therein an area number of the adjacent area; wall surface information data 92 including the information such as arrangement of a wall in the adjacent area; and window information data 93 including window information such as orientation of a window and size of the window in the adjacent area.

FIG. 6 is an explanatory diagram of an example of a data format of the computation request database.

The computation request database 63 is roughly divided to include building ID data 101, area ID data 102, PMV target value data 103, room temperature data 104, room humidity data 105, temperature setting data 106, air-conditioner operation status data 107, a group of data 108 for air-conditioning control setting, building information sequence number data 109, and area information sequence number data 110.

The building ID data 101 of the computation request database 63 stores therein a building ID for identifying a building to which an air-conditioning target area corresponding to a computation request belongs.

The area ID data 102 is used to identify the air-conditioning target area corresponding to the computation request.

The PMV target value data 103 stores therein a target PMV value preliminarily set for the air-conditioning target area.

The room temperature data 104 stores therein a room temperature actually measured by a temperature sensor in the air-conditioning target area.

The room humidity data 105 stores therein a room humidity actually measured by a humidity sensor in the air-conditioning target area.

The temperature setting data 106 stores therein a temperature setting set by a user or an operator for the air-conditioning target area.

The air-conditioner operation status data 107 indicates whether an air-conditioner is in operation.

The group of data 108 for air-conditioning control setting stores therein data set by the air-conditioning control device 13.

The building information sequence number data 109 stores therein a building information sequence number used to determine whether the building information of the building to which the air-conditioning target area belongs is updated.

The area information sequence number data 110 stores therein an area information sequence number of the air-conditioning target area used to determine whether the area information of the air-conditioning target area is updated.

In the above-described configuration, the group of data 108 for air-conditioning control settings includes: temperature setting data 111 in which a temperature setting set by the air-conditioning control device 13 is stored, and current PMV value data 112 in which a current PMV value computed by the air-conditioning control device 13 is stored.

Now, the correspondence relationship of various types of data stored as computation request data in the computation request database with actual air-conditioning target areas will be explained in detail.

Figure 7:
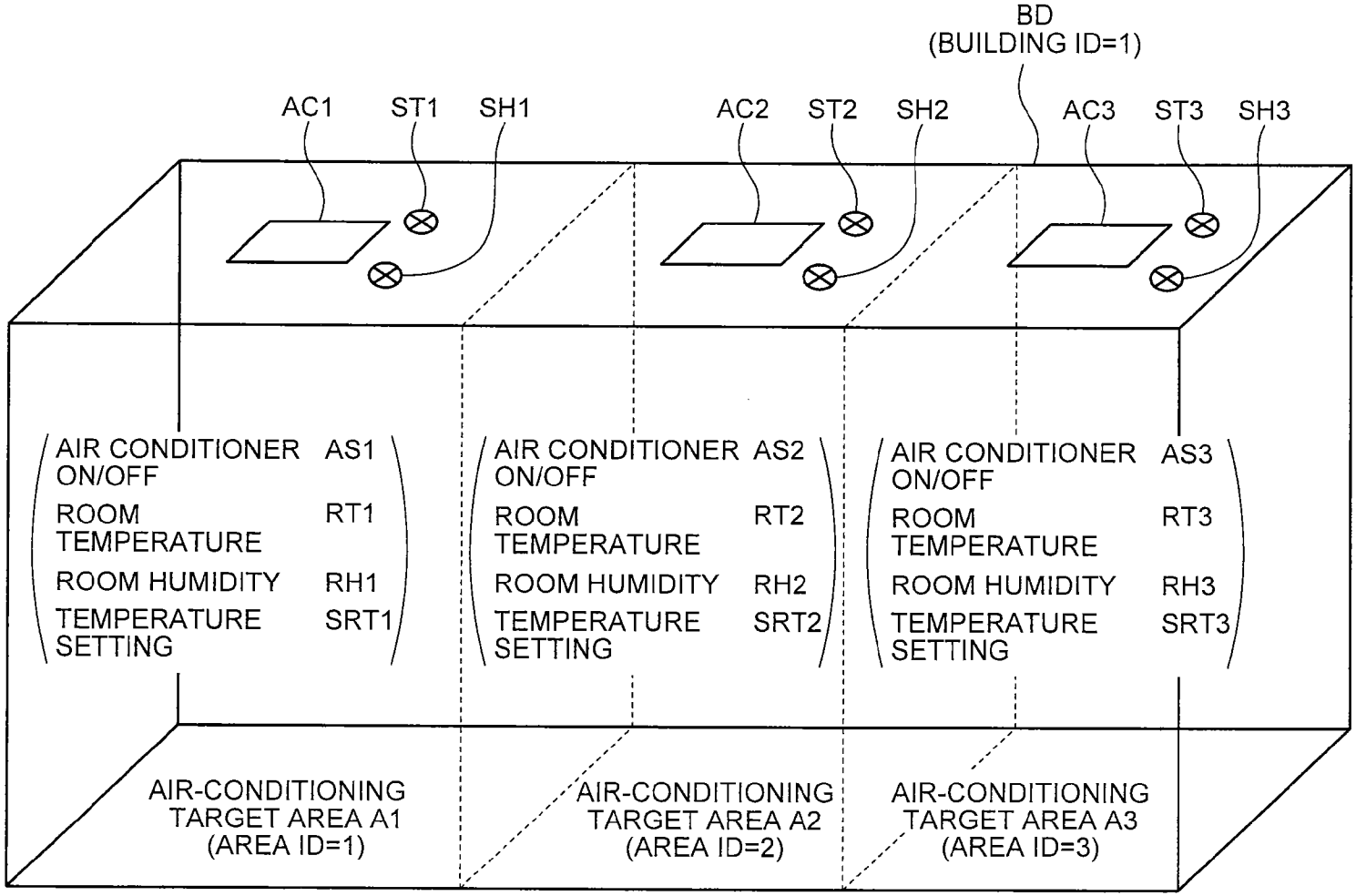
FIG. 7 is an explanatory diagram of a correspondence relationship between the computation request database and air-conditioning target areas according to the embodiment.

FIG. 7 is an explanatory diagram of the correspondence relationship between the computation request database and air-conditioning target areas.

In FIG. 7, in a building BD of building ID=1, three air-conditioning target areas A1 to A3 (area ID=1 to 3) are assumed to be present.

In the air-conditioning target area A1, an air conditioner AC1, and a room temperature sensor ST1 and a room humidity sensor SH1 accompanying the air conditioner AC1 are arranged. Likewise, in the air-conditioning target area A2, an air conditioner AC2, and a room temperature sensor ST2 and a room humidity sensor SH2 accompanying the air conditioner AC2 are arranged. Further, in the air-conditioning target area A3, an air conditioner AC3, and a room temperature sensor ST3 and a room humidity sensor SH3 accompanying the air conditioner AC3 are arranged.

In this case, the building ID=1 that identifies the building BD corresponding to the air-conditioning target area A1 is stored in the building ID data 101 of the computation request database 63.

Further, the area ID=1 that identifies the air-conditioning target area A1 is stored in the area ID data 102 of the computation request database 63.

The room temperature measured by the room temperature sensor ST1 is stored as room temperature data RT1 in the room temperature data 104 of the computation request database 63.

The room humidity measured by the room humidity sensor SH1 is stored as room humidity data RH1 in the room humidity data 105 of the computation request database 63.

A temperature setting data SRT1 corresponding to a temperature setting set by the user via an in-room controller not illustrated or a temperature setting preset by the operator is stored in the temperature setting data 106 of the computation request database 63.

The operating/non-operating (on/off) status of the air conditioner AC1 operated by the user via the in-room controller not illustrated is stored as air-conditioner operation status data AS1 in the air-conditioner operation status data 107 of the computation request database 63.

Similarly, the building ID=1 that identifies the building BD corresponding to the air-conditioning target area A2 is stored in the building ID data 101 of the computation request database 63, and the area ID=2 that identifies the air-conditioning target area A2 is stored in the area ID data 102 of the computation request database 63.

The room temperature measured by the room temperature sensor ST2 is stored as room temperature data RT2 in the room temperature data 104 of the computation request database 63, and the room humidity measured by the room humidity sensor SH2 is stored as room humidity data RH2 in the room humidity data 105 of the computation request database 63.

A temperature setting data SRT2 corresponding to a temperature setting set by the user via a in-room controller not illustrated or a temperature setting preset by the operator is stored in the temperature setting data 106 of the computation request database 63, and the operating/non-operating (on/off) status of the air conditioner AC2 is stored as air-conditioner operation status data AS2 in the air-conditioner operation status data 107 of the computation request database 63.

Furthermore, the building ID=1 that identifies the building BD corresponding to the air-conditioning target area A3 is stored in the building ID data 101 of the computation request database 63, and the area ID=3 that identifies the air-conditioning target area A3 is stored in the area ID data 102 of the computation request database 63.

The room temperature measured by the room temperature sensor ST3 is stored as room temperature data RT3 in the room temperature data 104 of the computation request database 63, and the room humidity measured by the room humidity sensor SH3 is stored as room humidity data RH3 in the room humidity data 105 of the computation request database 63.

A temperature setting data SRT3 corresponding to a temperature setting set by the user via an in-room controller not depicted or a temperature setting preset by the operator is stored in the temperature setting data 106 of the computation request database 63, and the operating/non-operating (on/off) status of the air conditioner AC3 is stored as air-conditioner operation status data AS3 in the air-conditioner operation status data 107 of the computation request database 63.

Next, the functional configuration of the air-conditioning control device 13 will be explained again.

In the air-conditioning control computation definition function unit 44, as mentioned in the explanation of the gateway function unit 42, various definitions are described, according to the specifications of the building management system basic function unit 41 to which the air-conditioning control device 13 is connected, to convert the data required for air-conditioning control computation out of the data acquired by the first data acquisition function unit 51 into computation request data having a common data format so that the air-conditioning control computation function unit 45 can compute.

In the air-conditioning control computation definition function unit 44, various definitions are further described to convert control data, which is a computation result of the air-conditioning control computation function unit 45, again into individual control output data complying with the specifications of a device or a system actually constituting the building management system basic function unit 41.

The air-conditioning control computation function unit 45 monitors the computation request database 63 of the database function unit 43 on the regular basis. When new computation request data is written to the computation request database 63, the air-conditioning control computation function unit 45 performs air-conditioning control computation based on the computation request data, and updates the computation request database 63 by including the computation result to the computation request data.

As a result, the second data acquisition function unit 53 of the gateway function unit 42 acquires the air-conditioning control computation resultant data that includes the computation result of the air-conditioning control computation function unit 45, and outputs the air-conditioning control computation resultant data to the second data write function unit 54. The second data write function unit 54 then converts the air-conditioning control computation resultant data into individual control output data which complies with the device or the system actually constituting the building management system basic function unit 41, and outputs the control output data to the building management system basic function unit 41.

Next, the operations in the embodiment will be explained.

The MPU 31 of the air-conditioning control device 13 serves as the air-conditioning control computation function unit 45 when started up, and performs an initial process.

Figure 8:
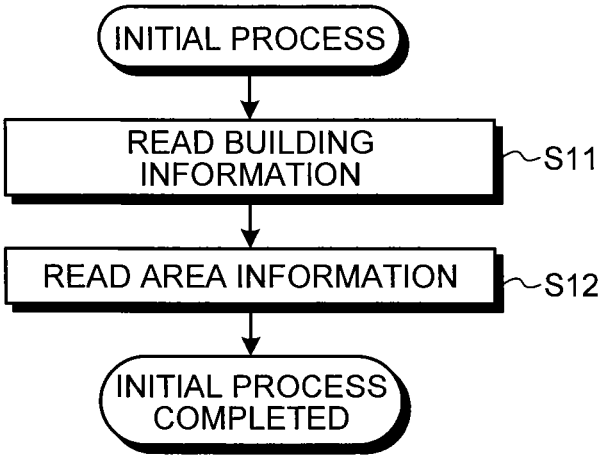
FIG. 8 is a processing flowchart of an initial process according to the embodiment.

FIG. 8 is a processing flowchart of the initial process.

The MPU 31 of the air-conditioning control device 13 refers to the database function unit 43, and carries out the process of reading out the building information database 61 (Step S11).

The MPU 31 then refers to the database function unit 43 again, and carries out the process of reading the area information database 62 (Step S12).

Figure 9:
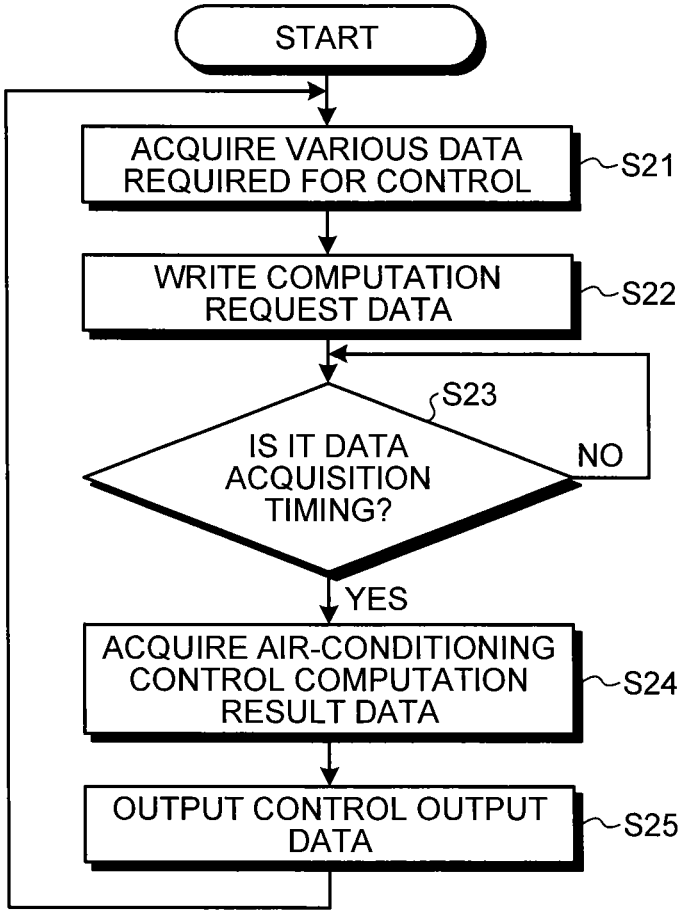
FIG. 9 is a processing flowchart of a gateway function unit in a routine process according to the embodiment.

FIG. 9 is a processing flowchart of the gateway function unit in a routine process.

Figure 10:
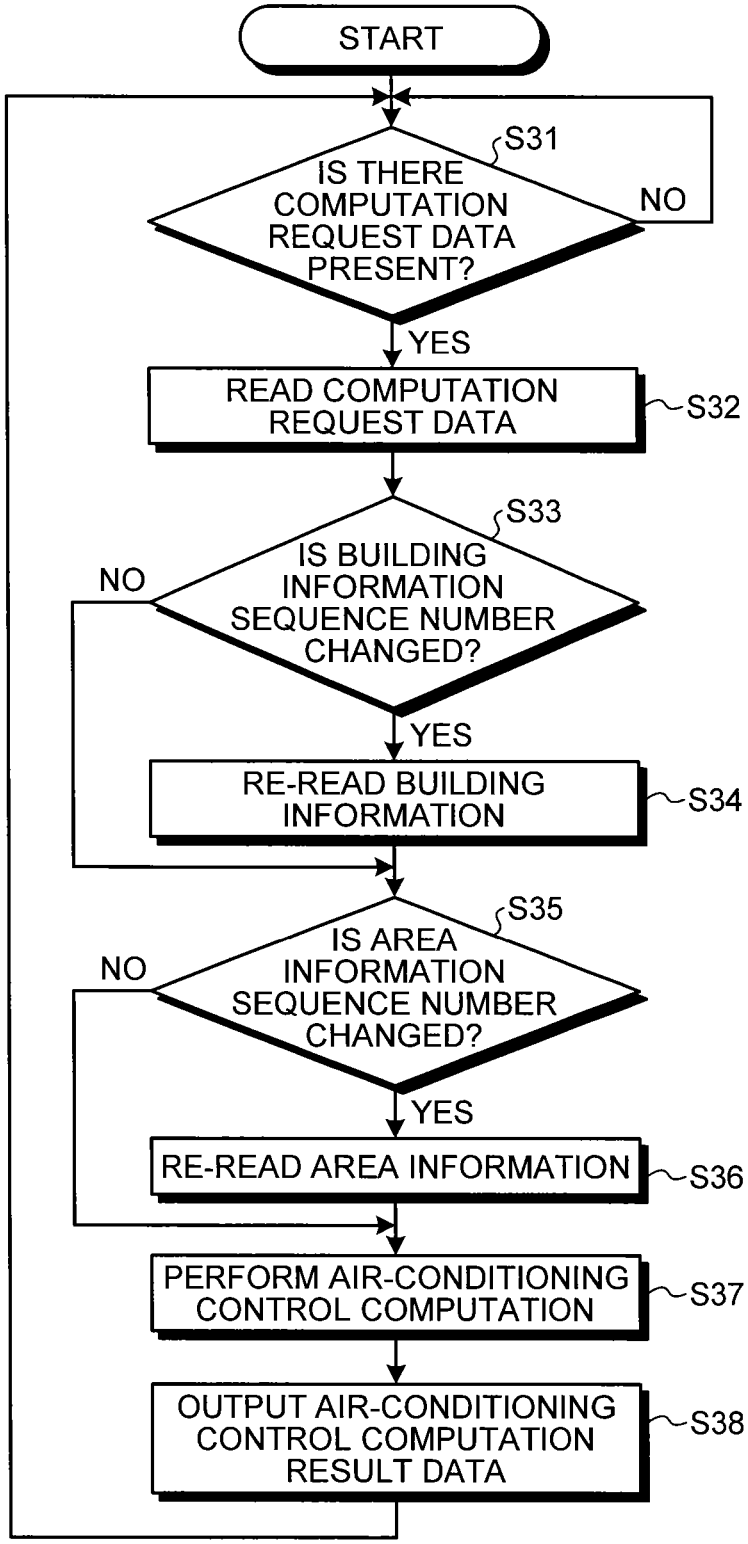
FIG. 10 is a processing flowchart of an air-conditioning control computation function unit in the routine process according to the embodiment.

FIG. 10 is a processing flowchart of the air-conditioning control computation function unit in the routine process.

When the initial process is completed, the MPU 31 of the air-conditioning control device 13 serves as the first data acquisition function unit 51 of the gateway function unit 42, and acquires various types of data required for control from the building management system basic function unit 41 (Step S21).

Accordingly, the MPU 31 of the air-conditioning control device 13 serves as the first data write function unit 52, and writes the various types of data acquired to the computation request database 63 of the database function unit 43 as computation request data (=air-conditioning control original data) (Step S22).

The MPU 31 serving as the gateway function unit 42 determines whether it is a timing to acquire air-conditioning control computation resultant data (=air-conditioning control computation resultant data) from the air-conditioning control computation function unit 45 (Step S23), and goes into a standby state (No at Step S23).

The operations serving as the first data acquisition function unit 51 and the first data write function unit 52 may be configured to be performed periodically or to be performed when requested from the building management system basic function unit 41.

Meanwhile, the MPU 31 of the air-conditioning control device 13 serves as the air-conditioning control computation function unit 45, and as illustrated in FIG. 10, determines whether there exists new computation request data (=computational data) not yet being computed (whether there is updated computation request data present) (Step S31).

In the determination at Step S31, if there exists no new computation request data or no updated computation request data (No at Step S31), the MPU 31 goes into a standby state.

On the other hand, if there exists new computation request data (=computing data) in the determination at Step S31 (Yes at Step S31), the MPU 31 serving as the air-conditioning control computation function unit 45 refers to the computation request database 63 of the database function unit 43, and reads the computation request data (=computing data) (Step S32).

The MPU 31 serving as the air-conditioning control computation function unit 45 then determines whether there is a change in the building information sequence number data 109 constituting the computation request data read (=computing data) with respect to the building sequence number corresponding to the building ID data 101 (Step S33).

In the determination at Step S33, if there is no change in the building information sequence number data 109 constituting the computation request data read (=computational data) with respect to the building information sequence number corresponding to the building ID data 101 (No at Step S33), the MPU 31 shifts the process to Step S35.

In the determination at Step S33, if there is a change in the building information sequence number data 109 constituting the computation request data read (=computational data) with respect to the building information sequence number corresponding to the building ID data 101 (Yes at Step S33), the MPU 31 re-reads the building information in the same manner as the process of reading building information (Step S11) carried out in the initial process (Step S34).

The MPU 31 then determines whether there is a change in the area information sequence number data 110 constituting the computation request data read (=computational data) with respect to the area information sequence number corresponding to the area ID data 102 (Step S35).

In the determination at Step S35, if there is no change in the area information sequence number data 110 constituting the computation request data read (=computational data) with respect to the area information sequence number corresponding to the area ID data 102 (No at Step S35), the MPU 31 shifts the process to Step S37.

In the determination at Step S35, if there is a change in the area information sequence number data 110 constituting the computation request data read (=computational data) with respect to the area information sequence number corresponding to the area ID data 102 (Yes at Step S35), the MPU 31 re-reads the area information (Step S36) in the same manner as the process of reading area information in the initial process (Step S12).

The MPU 31 serving as the air-conditioning control computation function unit 45 subsequently executes, based on the PMV target value data 103, the room temperature data 104, the room humidity data 105, and the temperature setting data 106 of an air-conditioning target area corresponding to the area ID data 102, air-conditioning control computation to compute the temperature setting data 111 and the current PMV value data 112 (Step S37). The MPU 31 then writes the temperature setting data 111 and the current PMV value data 112 that are the computation result (=air-conditioning control computation resultant data) to the computation request database 63 of the database function unit 43 (Step S38).

Thereafter, if the MPU 31 serving as the gateway function unit 42 determines in the determination at Step S23 that it is the timing to acquire the air-conditioning control computation resultant data from the air-conditioning control computation function unit 45 (Yes at Step S23), the MPU 31 serves as the second data acquisition function unit 53, and acquires the air-conditioning control computation resultant data computed by the air-conditioning control computation function unit 45 from the database function unit 43 (Step S24).

The MPU 31 then serves as the second data write function unit 54, and outputs the air-conditioning control computation resultant data acquired as the second data acquisition function unit 53 to the building management system basic function unit 41 as control output data (=air-conditioning control data) (Step S25).

While the process of the gateway function unit and the process of the air-conditioning control computation function are not carried out at the same time in the foregoing description of operations, it is possible to configure that these processes are carried out simultaneously in parallel.

As in the foregoing explanation, in accordance with the present embodiment, the fact that the configuration as the air-conditioning control computation function unit 45 can be made in the fixed form, regardless of the configuration of the building management body system 11 to which the air-conditioning control device 13 is connected facilitates the adoption of the air-conditioning control device 13 to an existing building management system.

In each building, there may be many cases where area information is needed because of coming and going of tenants and such. However, such a change in area information is appropriately reflected to the air-conditioning control computation in the air-conditioning control computation function unit 45. Furthermore, that enables air-conditioning control appropriate for the situation of the area to be performed.

Moreover, according to the air-conditioning control device 13, by appropriately registering and setting the information for a plurality of buildings and the information for the target areas of the buildings, the air-conditioning control can be provided for the respective buildings.

In this case, the method of saving data in an existing building management system differs depending on the building management system. Therefore, when designing the first data acquisition function unit 51, the second data write function unit 54, and the air-conditioning control computation definition function unit 44, a place to save, a format to save, and a procedure (protocol) thereof need to be checked and the design is made in accordance with their content.

For example, in the server 25 in FIG. 1, when various types of data are stored in a database format, the acquisition and the writing need to be performed by structured query language (SQL), and when various types of data are stored in a file format, the acquisition and the writing need to be performed by file transfer protocol (FTP).

In the foregoing explanation, various functions and a database function realized in the air-conditioning control device 13 are realized by placing a stand-alone air-conditioning control device. However, depending on the load in the air-conditioning control computation, it is also possible to realize such functions in appropriate devices in the building management system.

Figure 11:
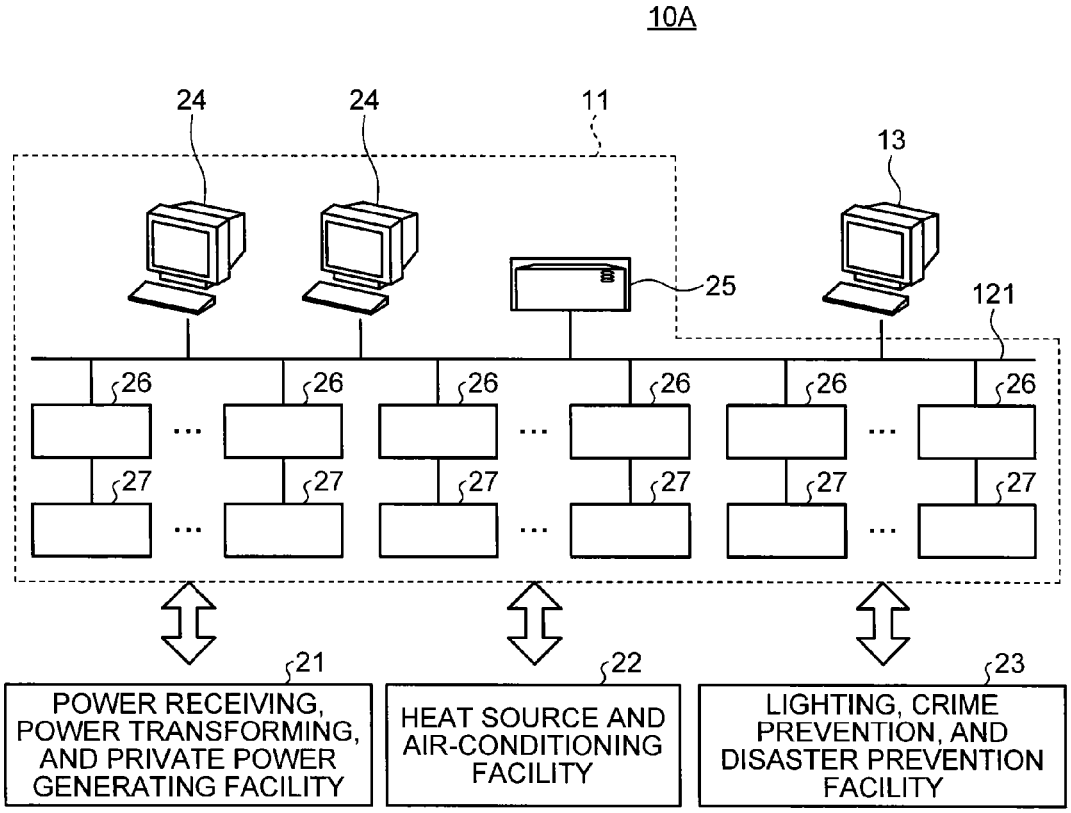
FIG. 11 is an explanatory diagram of a modification of the embodiment.

FIG. 11 is an explanatory block diagram of a modification of the embodiment.

In FIG. 11, the same constituents as those in FIG. 1 are given with the same reference numerals.

In the above-described explanation, the air-conditioning control device 13 is configured to be connected with air conditioners via the servers 25. However, in a building management system 10A in FIG. 11, the air-conditioning control device 13 directly controls the air conditioners via a data transmission path 121, which corresponds to the second data transmission path 28 in FIG. 1, without going through the server 25.

In this case, the data transmission path 121 can be considered to support, for example, a data communication protocol for building automation and control networks (BACnet protocol).

In the above-described configuration, in regard to the air-conditioning control, there is a possibility of the control competing against that of the server 25, and thus it is necessary to make the server 25 not to perform the air-conditioning control function that competes with the air-conditioning control device 13.

The control program executed in the air-conditioning control device in the present embodiment is provided in a file of an installable format or an executable format recorded on a computer readable recording medium such as a CD-ROM, a flexible disk (FD), a CD-R, and a digital versatile disk (DVD).

Furthermore, the control program executed in the air-conditioning control device in the present embodiment may be configured to be stored in a computer connected to a network such as the Internet and to be provided by downloading it via the network. The control program executed in the air-conditioning control device in the present embodiment may further be configured to be provided or distributed via a network such as the Internet.

The control program of the air-conditioning control device in the present embodiment may further be configured to be provided being embedded in a ROM and such in advance.

The control program executed in the air-conditioning control device in the present embodiment is configured as modules to include the aforementioned units (the gateway function unit 42, the first data acquisition function unit 51, the first data write function unit 52, the second data acquisition function unit 53, the second data write function unit 54, the database function unit 43, the air-conditioning control computation definition function unit 44, and the air-conditioning control computation function unit 45).

In this case, as for the actual hardware, an MPU (processor) reads out the control program from the above-described storage medium or the ROM and such and executes it to load the respective modules into a main memory, whereby the gateway function unit 42, the first data acquisition function unit 51, the first data write function unit 52, the second data acquisition function unit 53, the second data write function unit 54, the database function unit 43, the air-conditioning control computation definition function unit 44, and the air-conditioning control computation function unit 45 are generated on the main memory.

While certain embodiments of the present invention have been explained in the foregoing, these embodiments have been presented by way of example only, and are not intended to limit the scope of the invention. These novel embodiments described herein may be embodied in a variety of other forms. Furthermore, various omissions, substitutions, and changes to the embodiments may be made without departing from the spirit of the invention. These embodiments and such modifications would fall within the scope and spirit of the invention and are intended to be covered by the accompanying claims and their equivalents.

The invention claimed is:

1. An air-conditioning control device comprising:

a conversion definition information storage unit that preliminarily stores therein conversion definition information for converting air-conditioning control original data acquired from an external air-conditioning facility into computational data for performing an air-conditioning control computation or conversion definition information for converting air-conditioning control computation resultant data acquired as a result of the air-conditioning control computation into air-conditioning control data used for air-conditioning control at the air-conditioning facility;

an air-conditioning control computation unit that performs the air-conditioning control computation based on the computational data, and outputs the air-conditioning control computation resultant data; and a gateway unit that refers to the conversion definition information to convert the air-conditioning control original data into the computational data for the air-conditioning control computation or to convert the air-conditioning control computation resultant data acquired as a result of the air-conditioning control computation into the air-conditioning control data to be used for the air-conditioning control at the air-conditioning facility;

wherein the gateway unit includes:

a first data acquisition unit that acquires the air-conditioning control original data from the air-conditioning facility, a first data write unit that refers to the conversion definition information to convert the air-conditioning control original data acquired by the first data acquisition unit to the computational data, and writes the computational data into a database of a database unit, a second data acquisition unit that acquires the air-conditioning control computation resultant data from the air-conditioning control computation unit via the database unit, and a second data write unit that refers to the conversion definition information to convert the air-conditioning control computation resultant data acquired by the second data acquisition unit to the air-conditioning control data, and outputs the air-conditioning control data to the air-conditioning facility.

2. The air-conditioning control device of claim 1, wherein, if a plurality of air-conditioning facilities are provided, the conversion definition information storage unit preliminarily stores therein the conversion definition information for each of the air-conditioning facilities.

3. The air-conditioning control device of claim 1, wherein:

the database unit temporarily stores therein the computational data and the air-conditioning control computation resultant data, as a database, wherein the air-conditioning control computation unit refers to the database to perform the air-conditioning control computation.

4. The air-conditioning control device of claim 1, wherein the database unit has a computation request table storing therein the computational data of a computation request target, and the air-conditioning control computation unit performs the air-conditioning control computation if, as a trigger, the computational data is stored in the computation request table.

5. The air-conditioning control device of claim 1, wherein the air-conditioning control original data includes at least one of temperature information of an air-conditioning target area, humidity information of the air-conditioning target area, and operation status information of the air-conditioning facility.

6. The air-conditioning control device of claim 1, wherein the air-conditioning control original data includes area information on an air-conditioning target area and building information on a condition of placement of a building where the area is positioned.

7. The air-conditioning control device of claim 6, wherein the air-conditioning control original data includes, as the area information, adjacent area specifying information for specifying an area adjacent to the air-conditioning target area.

8. The air-conditioning control device of claim 1, wherein, if the air-conditioning facility adopts a PMV control system, the air-conditioning control computation unit includes current PMV value data as the air-conditioning control computation resultant data.

9. An air-conditioning control method performed by an air-conditioning control device connected to an external air-conditioning facility via a data transmission path, the air-conditioning control method comprising:

a conversion definition information storing that preliminarily stores conversion definition information for converting air-conditioning control original data acquired from the air-conditioning facility via the data transmission path or conversion definition information for converting air-conditioning control computation resultant data acquired as a result of the air-conditioning control computation into air-conditioning control data used for air-conditioning control at the air-conditioning facility;

an air-conditioning control computation that performs the air-conditioning control computation based on the computational data, and output the air-conditioning control computation resultant data; and a gatewaying that refers to the conversion definition information to convert the air-conditioning control original data into the computational data for the air-conditioning control computation or to convert the air-conditioning control computation resultant data acquired as a result of the air-conditioning control computation into the air-conditioning control data to be used for the air-conditioning control at the air-conditioning facility;

wherein the gatewaying includes:

a first data acquisition that acquires the air-conditioning control original data from the air-conditioning facility, a first data writing that refers to the conversion definition information to convert the air-conditioning control original data acquired by the first data acquisition to the computational data, and writes the computational data into a database of a database unit, a second data acquisition that acquires the air-conditioning control computation resultant data from the air-conditioning control computation unit via the database unit, and a second data writing that refers to the conversion definition information to convert the air-conditioning control computation resultant data acquired by the second data acquisition unit to the air-conditioning control data, and outputs the air-conditioning control data to the air-conditioning facility.

10. A non-transitory computer readable medium storing a computer program for controlling an air-conditioning control device connected to an external air-conditioning facility via a data transmission path by a computer, the control program causes the computer to function as:

a conversion definition information storing unit that preliminarily stores conversion definition information for converting air-conditioning control original data acquired from the air-conditioning facility via the data transmission path or conversion definition information for converting air-conditioning control computation resultant data acquired as a result of the air-conditioning control computation into air-conditioning control data used for air-conditioning control at the air-conditioning facility;

an air-conditioning control computation unit that performs the air-conditioning control computation based on the computational data, and output the air-conditioning control computation resultant data; and a gateway unit that refers to the conversion definition information to convert the air-conditioning control original data into the computational data for the air-conditioning control computation or to convert the air-conditioning control computation resultant data acquired as a result of the air-conditioning control computation into the air-conditioning control data to be used for the air-conditioning control at the air-conditioning facility;

wherein the gateway unit includes:

a first data acquisition unit that acquires the air-conditioning control original data from the air-conditioning facility, a first data write unit that refers to the conversion definition information to convert the air-conditioning control original data acquired by the first data acquisition unit to the computational data, and writes the computational data into a database of a database unit, a second data acquisition unit that acquires the air-conditioning control computation resultant data from the air-conditioning control computation unit via the database unit, and a second data write unit that refers to the conversion definition information to convert the air-conditioning control computation resultant data acquired by the second data acquisition unit to the air-conditioning control data, and outputs the air-conditioning control data to the air-conditioning facility.

* * * * *